US011371494B2

(12) United States Patent
Saunders et al.

(10) Patent No.: US 11,371,494 B2
(45) Date of Patent: Jun. 28, 2022

(54) SOLID PARTICULATE PUMP

(71) Applicant: GAS TECHNOLOGY INSTITUTE, Des Plaines, IL (US)

(72) Inventors: Timothy W Saunders, Rancho Palos Verdes, CA (US); Joseph Caravella, Sherman Oaks, CA (US)

(73) Assignee: GAS TECHNOLOGY INSTITUTE, Des Plaines, IL (US)

( * ) Notice: Subject to any disclaimer, the term of this patent is extended or adjusted under 35 U.S.C. 154(b) by 51 days.

(21) Appl. No.: 16/588,028

(22) Filed: Sep. 30, 2019

(65) Prior Publication Data

US 2020/0102942 A1 Apr. 2, 2020

Related U.S. Application Data

(60) Provisional application No. 62/740,164, filed on Oct. 2, 2018.

(51) Int. Cl.
*F04B 19/14* (2006.01)
*F04B 19/20* (2006.01)

(52) U.S. Cl.
CPC ..... *F04B 19/14* (2013.01); *F04B 19/20* (2013.01)

(58) Field of Classification Search
CPC ..... F04B 19/14; F04B 19/20; B65G 15/12–18
USPC ..... 198/626.1–626.6; 417/320
See application file for complete search history.

(56) References Cited

U.S. PATENT DOCUMENTS

| | | | | |
|---|---|---|---|---|
| 3,718,819 | A * | 2/1973 | Miksitz | G01N 23/12 250/358.1 |
| 3,880,274 | A | 4/1975 | Bechtloff et al. | |
| 4,154,560 | A * | 5/1979 | Streicher | F04B 19/14 418/4 |
| 5,137,144 | A * | 8/1992 | Uehara | B65G 17/10 198/698 |
| RE42,844 | E | 10/2011 | Sprouse et al. | |
| 8,439,185 | B2 | 5/2013 | Fitzsimmons | |
| 8,893,878 | B2 * | 11/2014 | Sprouse | C10J 3/30 198/626.1 |
| 8,939,278 | B2 * | 1/2015 | Fitzsimmons | F23G 5/444 198/626.1 |
| 9,944,465 | B2 | 4/2018 | Saunders | |
| 2007/0163606 | A1 * | 7/2007 | Chojnacki | B65G 15/14 131/111 |

(Continued)

OTHER PUBLICATIONS

ISA/US, English language version of the International Search Report, Form PCT/ISA/210 for International Application PCT/US2019/053973, dated Dec. 4, 2019 (2 pages).

(Continued)

*Primary Examiner* — Kenneth J Hansen
*Assistant Examiner* — Thomas Fink
(74) *Attorney, Agent, or Firm* — Pauley Erickson & Swanson

(57) ABSTRACT

A pump for transporting particulate material that includes a first conveyor and a second conveyor together defining a passage, wherein a working surface of each of the conveyors are canted with respect to each other. The pump includes an inlet for introducing the particulate material into the passage and an outlet for expelling the particulate material from the passage, wherein the outlet is positioned out of line with the inlet.

17 Claims, 10 Drawing Sheets

(56) References Cited

U.S. PATENT DOCUMENTS

2008/0060914 A1* 3/2008 Sprouse ..... F04B 19/20 198/626.1
2008/0302708 A1 12/2008 Kawakami
2010/0320061 A1* 12/2010 Saunders ..... F04B 19/20 198/626.1
2011/0139257 A1* 6/2011 Bielenberg ..... B01J 8/0045 137/1
2011/0139583 A1* 6/2011 Bielenberg ..... C10J 3/50 198/604
2011/0247919 A1* 10/2011 Fitzsimmons ..... F04B 19/20 198/626.1
2012/0048408 A1* 3/2012 Saunders ..... F23K 3/00 137/565.17
2012/0097506 A1* 4/2012 Bebejian ..... F04B 19/20 198/853
2012/0186946 A1* 7/2012 Saunders ..... F04B 19/20 198/626.1
2012/0321444 A1* 12/2012 Sonwane ..... C10J 3/506 415/121.1
2013/0115033 A1 5/2013 Lukes et al.
2015/0353284 A1* 12/2015 Sprouse ..... F04B 19/20 198/626.1
2016/0083187 A1* 3/2016 Saunders ..... F04B 15/00 198/540

OTHER PUBLICATIONS

ISA/US, English language version of the Written Opinion of the International Searching Authority, Form PCT/ISA/237 for International Application PCT/US2019/053973, dated Dec. 4, 2019 (5 pages).

* cited by examiner

SOLID PARTICULATE PUMP

CROSS REFERENCE TO RELATED APPLICATION

This application claims the benefit of U.S. Provisional Patent Application Ser. No. 62/740,164, filed on 2 Oct. 2018. This Provisional Application is hereby incorporated by reference herein in its entirety and is made a part hereof, including but not limited to those portions which specifically appear hereinafter.

GOVERNMENT RIGHTS

This invention was made with government support under Contract No. DE-FE0012062 awarded by the U.S. Department of Energy. The government has certain rights in the invention.

BACKGROUND OF THE INVENTION

Field of the Invention

This disclosure relates to a solid particulate pump for transporting particulate material.

Description of Related Art

Processing of particulate material can require transportation of the material from one environment into another, such as from a relatively low pressure environment to a relatively high pressure environment. For example, coal gasification involves the conversion of coal or other carbonaceous particulate material into synthesis gas. A coal gasification system typically operates at pressures above the ambient surroundings. A feeder or pump is used to introduce pulverized, particulate coal or other particulated carbonaceous material from the relatively low pressure surrounding environment into the higher pressure coal gasification system.

The coal gasification process may involve conversion of the particulate coal or other carbon-containing material into synthesis gas. Dry coal or particulate pumping may be more thermally efficient than traditional water slurry technology. However, some existing or traditional dry coal feed systems may suffer from internal shear failure zones, flow stagnation, binding or other mechanical failures related to the delivery of such particulate.

Examples of various improved dry coal or particulate pumps may be found in U.S. Patent RE42,844, U.S. Pat. No. 8.439,185, and U.S. Pat. No. 9,944,465, and are each incorporated by reference. Such dry solids pumps generally utilize two parallel belt assemblies that direct material linearly through a passageway.

SUMMARY OF THE INVENTION

A solid particulate pump according to an example of the present disclosure includes a plurality of segments arranged on a belt. Each segment includes an inner link and an outer tile. The plurality of segments preferably attach to each other in a serial, closed loop arrangement.

The segments preferably include, respectively, links secured with, respectively, tile segments that have upper working surfaces. The working surfaces are preferably angled along a direction of movement of the respective belt. In this way the collective working surfaces of each belt are canted relative to each other.

A solid particulate pump for transporting particulate material according to an example of the present disclosure includes a feeder inlet, a feeder outlet downstream from the feeder inlet and a particulate conveyor operable to transport a particulate material from the feeder inlet to the feeder outlet. The feeder outlet is preferably offset from the feeder inlet such that the feeder outlet is not in linear alignment with the feeder inlet. Further a discharge port of the pump is positioned above the outlet and relative to gravity to create a seal between the discharge port and an interior of the pump.

A method for managing binding or fouling of a solid particulate pump for transporting particulate material according to an example of the present disclosure includes transporting particulate material from a solid particulate pump inlet to a solid particulate pump outlet having a side exit upward discharge downstream from the solid particulate pump inlet using a closed loop, particulate conveyor.

BRIEF DESCRIPTION OF SEVERAL VIEWS OF THE DRAWINGS

Objects and features of this invention will be better understood from the following description taken in conjunction with the drawings.

DETAILED DESCRIPTION

Figure 1:
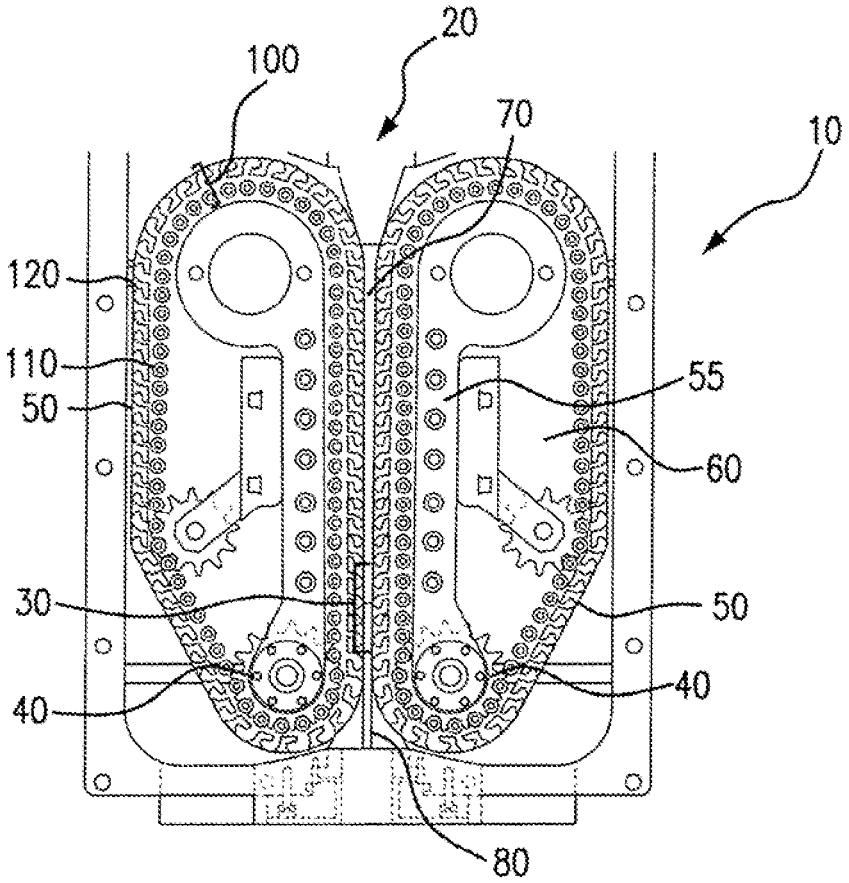
FIG. 1 is a cross-sectional partial front side view of a device according to one preferred embodiment.

FIG. 1 illustrates an example solid particulate pump 10 adapted for transporting particulate material, such as but not limited to, particulated carbonaceous materials. Such materials can include feed stocks such as petcoke, coal, sub-bit coal or the like, for example. As will be appreciated from this disclosure, the solid particulate pump 10 includes various moveable components that operate to transport particulate material from a feeder inlet 20 to a feeder outlet 30 located downstream and preferably offset from the feeder inlet 20. As will be described in further detail below, the solid particulate pump 10 includes features for directing flow of particulate material, managing infiltration of particulate material into the moveable components, and other features to minimize a build-up of particulate material and fouling or binding of the components.

A feeder inlet may be provided in the form of a hopper having an agitator and/or a specialized tapered form to permit infeed of particulate material without clumping or other interruption. In one preferred embodiment an active hopper is utilized having a trapezoidal opening to provide particulate material to the inlet 20.

In the illustrated example, the solid particulate pump 10 includes two belt assemblies, more particularly particulate conveyors 50 that are arranged opposite of each other to provide moving side walls of the solid particulate pump 10. Together, the particulate conveyors 50 and the lateral walls 60 of the solid particulate pump 10 define a passage 70 through which particulate matter is transported between the feeder inlet 20 and the feeder outlet 30. As shown in FIG. 1, the feeder outlet 30 projects forward or rearward of the view shown. In one example based on a coal gasification system, the feeder inlet 20 would be at a lower pressure than the feeder outlet 30 and thus the solid particulate pump 10 would operate to transport the particulate material from a low pressure environment into a high pressure environment. The particulate conveyors 50 of the illustrated example transport the particulate material without substantially "grinding" the material such that the particulate material, on average, has a similar size before and after the solid particulate pump 10.

In this example, the passage 70 has a substantially uniform cross-sectional area from the feeder inlet 20 toward the feeder outlet 30, although the passage 70 can alternatively converge to the feeder outlet 30. Additionally, although shown with two particulate conveyors 50, it is to be understood that the examples herein are not limited to such an arrangement and that other feeder designs can include additional particulate conveyors 50.

One or more drive sprockets preferably engage the particulate conveyor 50 for driving movement of the particulate conveyor 50. The particulate conveyors 50 may be separately powered or connected together to a single drive system.

Figure 2:
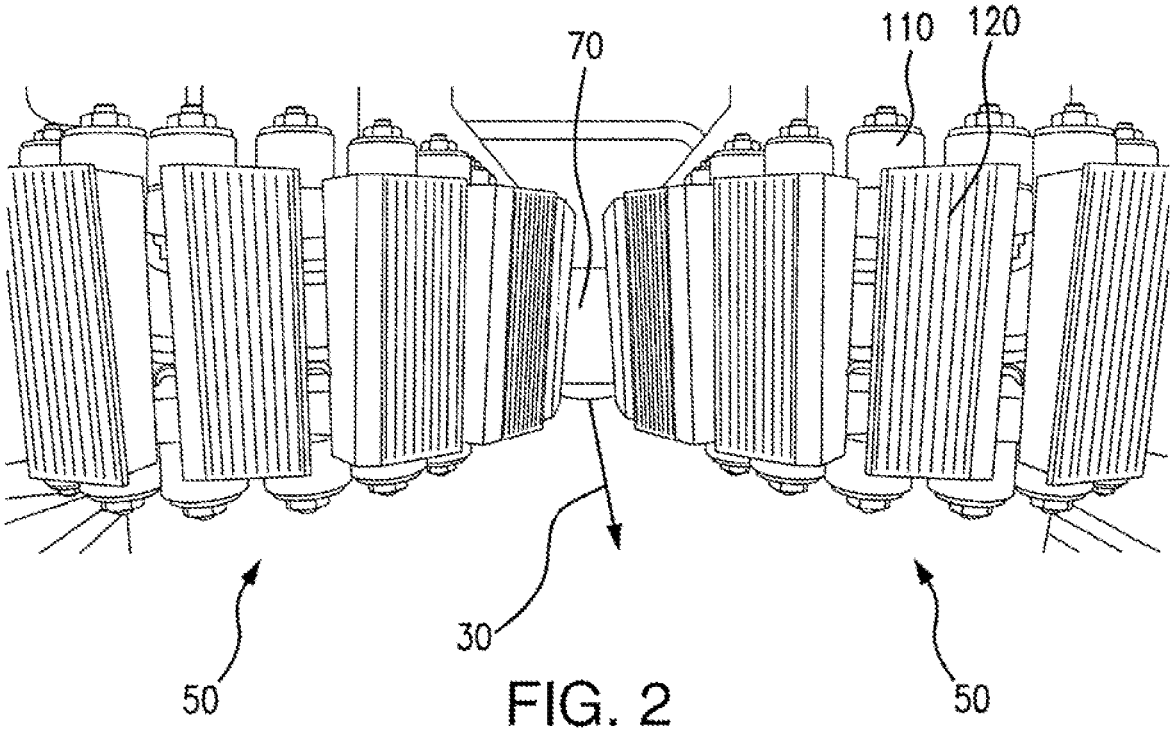
FIG. 2 is a top view of a pair of conveyors according to one preferred embodiment.

Referring to FIG. 2 showing a top view of the passage 70 between the particulate conveyors 50, the two particulate conveyors 50 preferably angled or canted relative to each other, more preferably the conveyors 50 include tiles 120 with working surfaces 125 that are angled or canted relative to each other. More preferably, a distance between the two particulate conveyors 50 is preferably wider toward a side of the particulate pump 10 on which the outlet 30 is positioned, as described in more detail below. The particulate conveyor 50 in this manner is operable to move the particulate material through the solid particulate pump 10 from the inlet 20 to the outlet 30.

Figure 3:
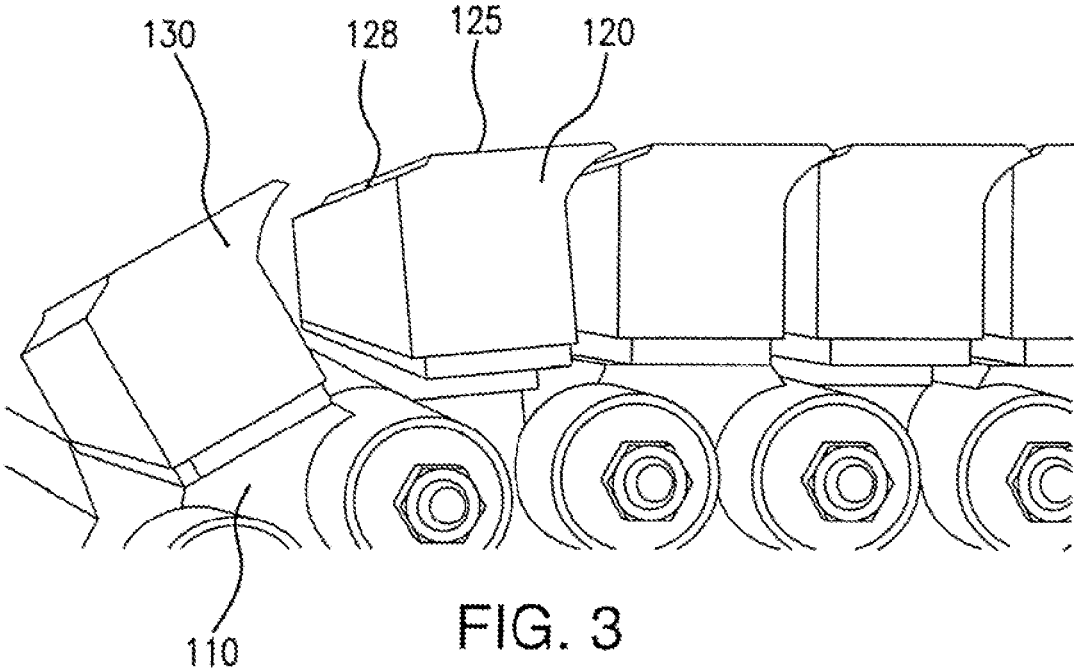
FIG. 3 is a front side view of a conveyor according to one preferred embodiment.

As depicted in FIGS. 3-7, the particulate conveyor 50 includes a plurality of distinct segments 100 that are attached or linked to each other in a serial, closed loop arrangement. FIG. 3 shows one preferred embodiment of segments 100 of a respective particulate conveyor 50. Each segment 100 preferably includes an inner link 110 and an outer tile 120. The plurality of segments 100 preferably attach to each other in a serial, closed loop arrangement. Each segment 100 includes an inner link 110 and an outer tile 120 that is secured to the respective link 110. As used herein, the inner link 110 is intended to assist in the movement of the conveyor 50 through the particulate pump and the tile 120 is intended to face and convey the particulate to be conveyed.

The tile 120 preferably include an upper working surface 125 that is directly exposed to the particulate material in the passage 70. The working surfaces 125 of each tile 120 preferably overlap each adjacent tile, as depicted in FIGS. 3 and 4, and serve to support and act upon the particulate material in the passage 70.

Figure 4:
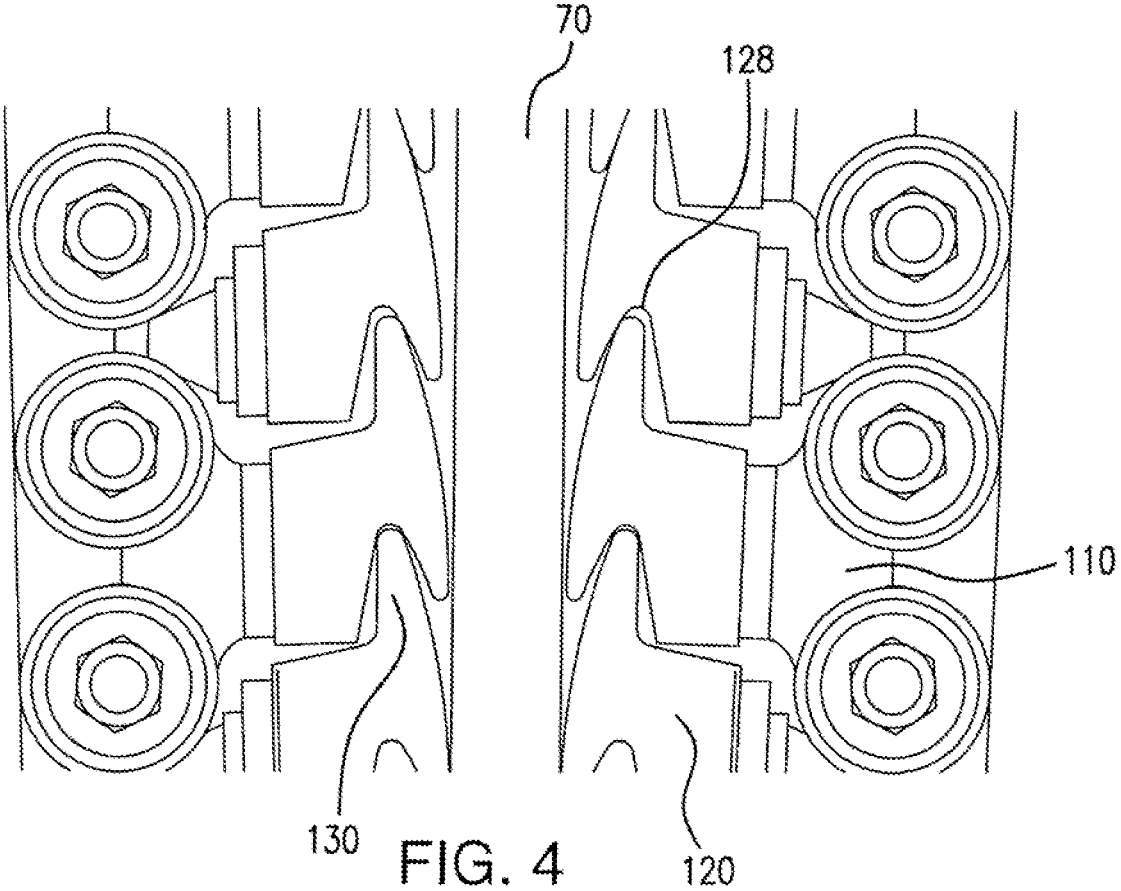

FIG. 4 demonstrates one preferred embodiment showing a linear offset between the segments of the two particulate conveyors 50. By offsetting the position of opposing tiles 120, the particulate material may be better contained within the passage during transport. In addition, the offset tiles 120 reduce the magnitude of fluctuation but increase its frequency thereby resulting in smoother transport of particulate material. Lastly, a 50% offset minimizes torque fluctuations within the adjacent conveyors 50, more specifically the drive assembly 40 of the adjacent conveyors 50.

As shown in FIGS. 3 and 4 in different embodiments, each working surface 125 of each tile 120 preferably includes a leading notch or flat 128 and a trailing tail 130. As shown in FIGS. 3 and 4, the tail 130 is capable of close contact with the notch 128 when each conveyor 50 is in a conveying position, i.e., generally parallel with, and opposite, the opposing conveyor 50. In this manner, particulate material is kept contained within the passage 70 during transport through the particulate pump 10. In one preferred embodiment, a continuous belt may overlay the tiles 120 to provide sealing to the components.

Figure 5:
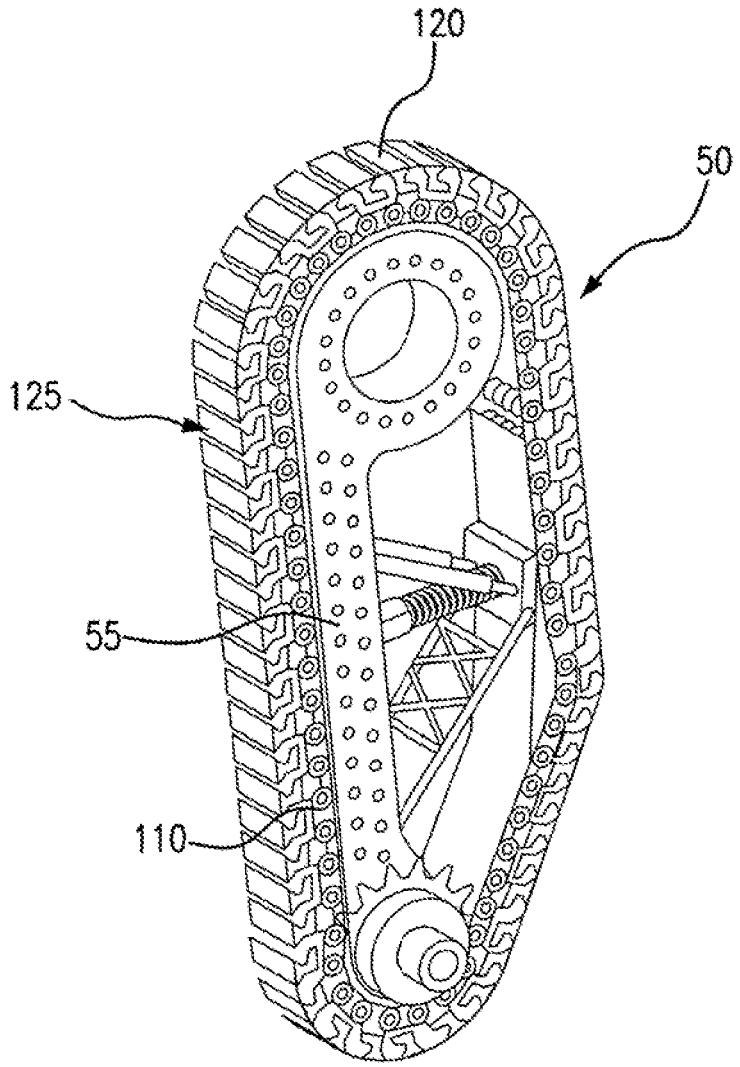
FIG. 5 is the isometric perspective front view of a conveyor according to one embodiment.
Figure 6:
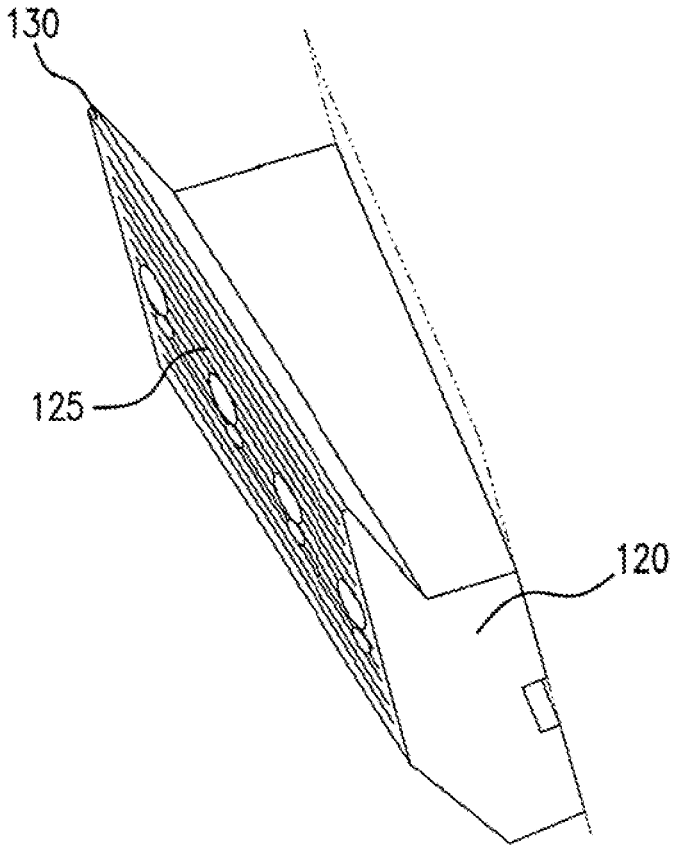
FIG. 6 is a front side perspective view of a tile from the conveyor shown in FIG. 5.
Figure 7:
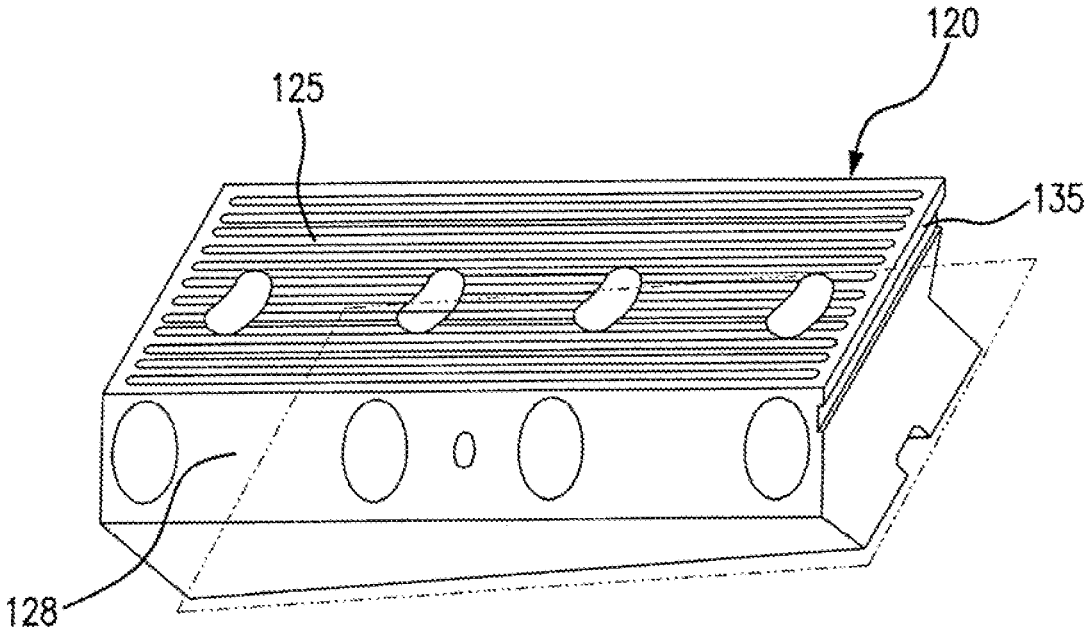
FIG. 7 is side perspective view of the tile shown in FIG. 6.

In addition, as best shown in FIGS. 5-7, each tile 120 preferably includes an inclined working surface 125 that angles relative to a plane of conveyance and more particularly angled toward the feeder outlet 30 positioned at a distal end of the particulate pump 20. As shown in FIGS. 6 and 7, the leading surface comprises a flat 128 against which the trailing tail 130 engages to create a generally cohesive working surface 125 of the conveyors 50 that contacts the particulate material.

As shown in FIGS. 2-4, each of the links 110 preferably include a pivotable connector to join the links 110 to form the conveyor 50 upon which wheels or a similar structure are mounted for guiding the conveyor 50 along a load beam 55. A load beam 55 is preferably positioned within each conveyor 50 for support and structural integrity.

As shown in FIG. 7, tiles 120 may include grooves 135 to accommodate seals to further contain the particulate matter within the passage 70. The segments 100 may further include seals positioned between adjacent segments in an endless, closed loop that are incorporated into the conveyors 50. Alternatively, the seals may be segmented such that each seal segment extends between a neighboring pair of the segments 100. Such seals may prevent the particulate matter from infiltrating around stationary and moving parts of the solid particulate pump 10. This build-up can hinder movement of parts, such as the drive system including sprockets and wheels, and can also hinder relative movement between segments 100 to alter the path of the segments 100 around the closed loop arrangement. Such seals thus serve as a particle barrier to the particulate material and prevents infiltration of the particulate material to enhance reliability of the solid particulate pump 10.

Figure 8:
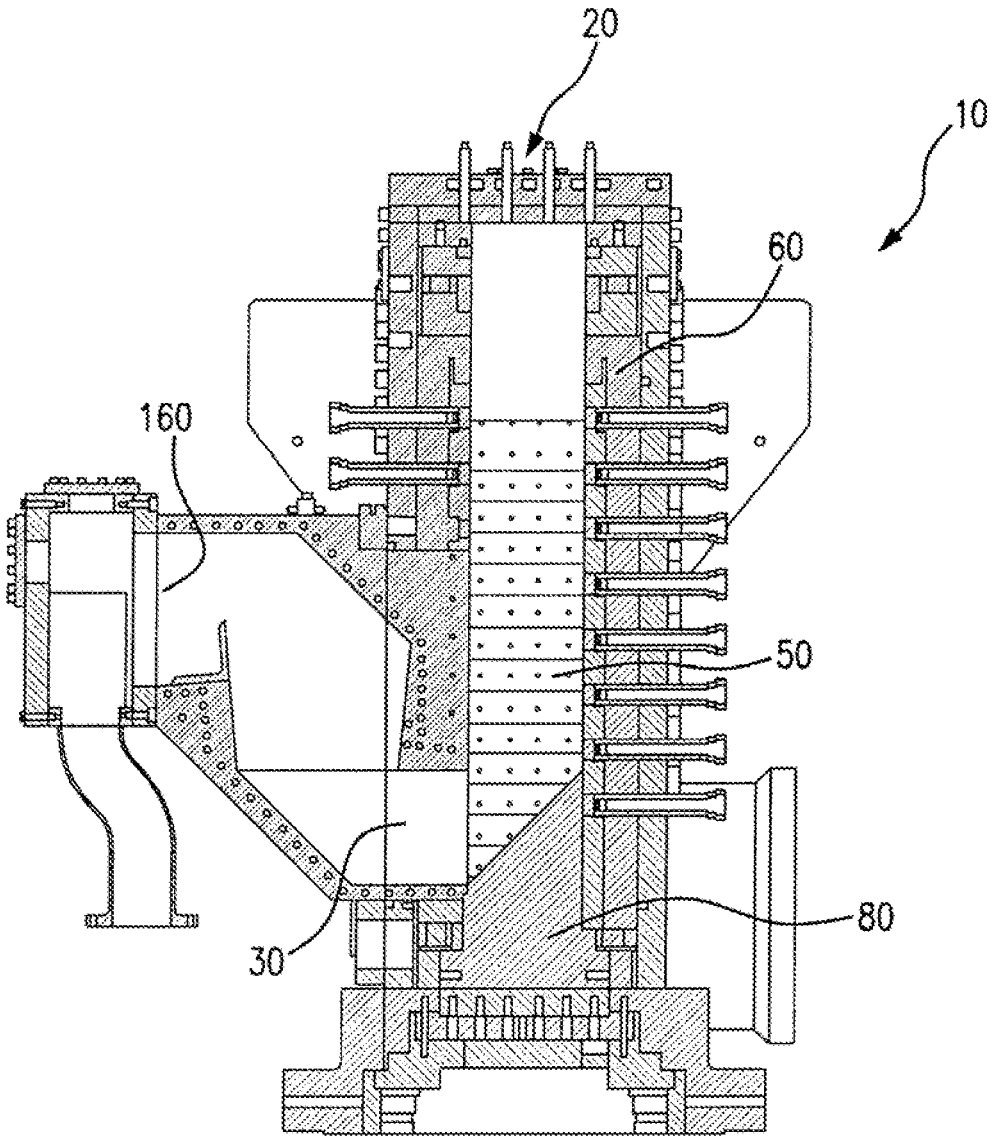
FIG. 8 is a cross-sectional left side view of a device according to one preferred embodiment.

One aspect of the subject invention, in part addressed by the seals described above, is limiting fine particulate materials from entering the internal space/casing of the particulate pump 10 where working/moving components of the pump are located. This may be accomplished by diaphragm-type seals under the tiles, close tolerances of all parts containing particulates and piston type seals penetrating the sides of the tiles over the particulates containing length of duct. Additionally, any particulate fines that do enter the spaces holding the moving components of the particulate pump 10 are handled to prevent impact to tight clearances between internal moving components and trajectory of the belt components on the load beam 55. Methods used to handle such particulate fines are specifically located catchment/repositories to collect the tines and air flows and jets to direct the fines to the repositories from other locations. The repositories are then configured to discharge the fines away from the pump casing by vacuum or other means, Referring again to FIG. 1, the particulate material is fed through the particulate pump along the working surfaces 125 of the conveyors 50 until it reaches an outlet 30 which is preferably positioned in a side and not a distal end of the particulate pump. FIG. 8 shows a similar particulate pump 10 as shown in FIG. 1 from a side view to show the outlet 30. More particularly, the outlet 30 comprises a side exit downward discharge (not shown) or a side exit upward discharge (SEUD) as shown in FIGS. 8-10.

Figure 9:
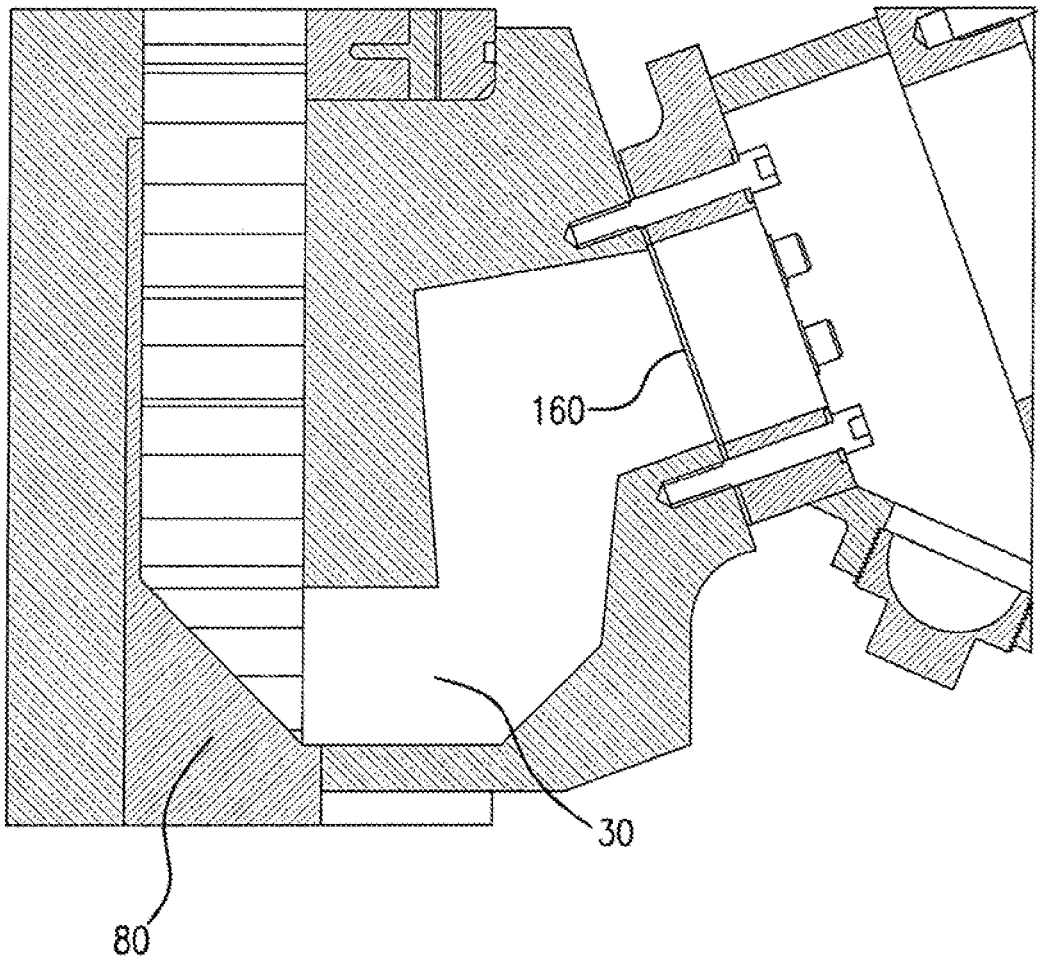
FIG. 9 is a cross-sectional right side view of a side exit discharge according to one preferred embodiment.
Figure 10:
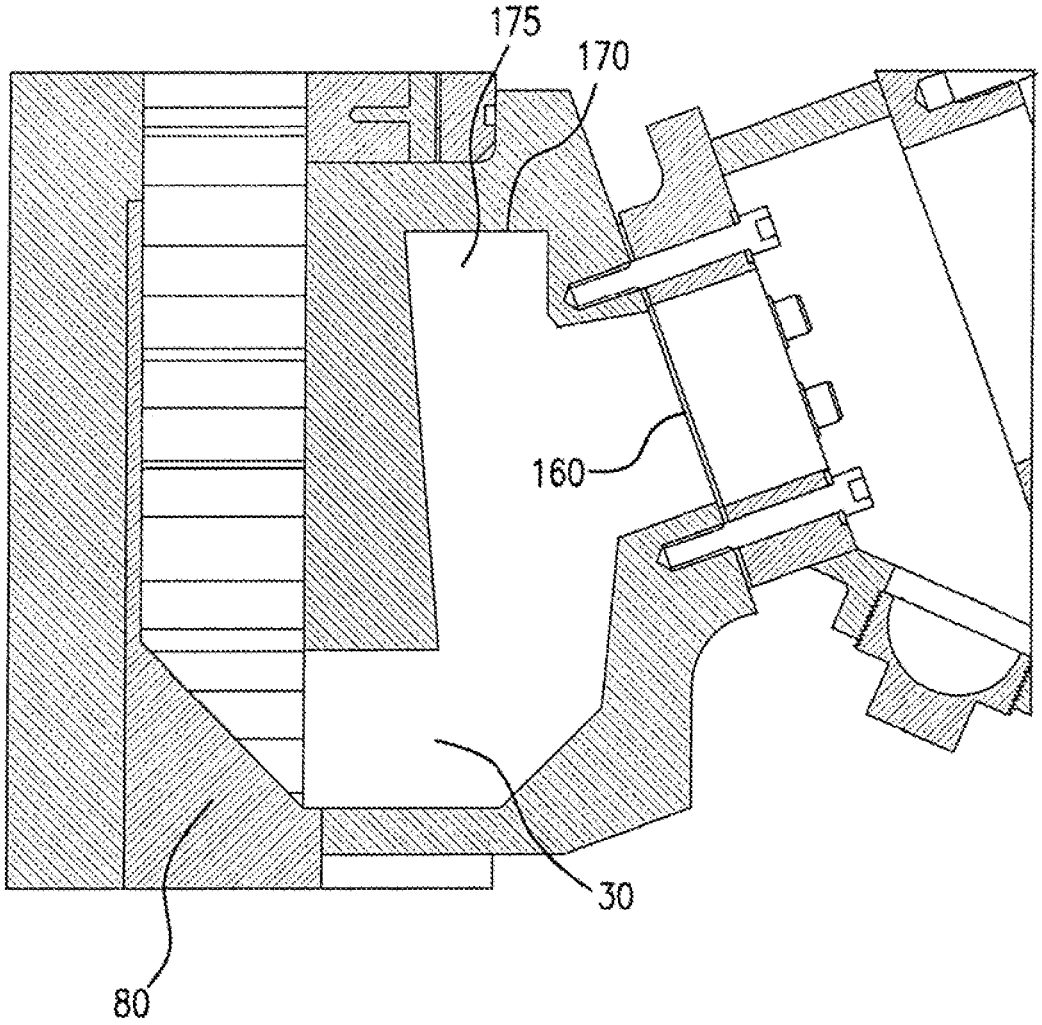
FIG. 10 is a cross-sectional right side view of a side exit discharge according to one preferred embodiment.

As best shown in FIGS. 9 and 10, a diverter 80 is positioned at an outlet end of the passage 70. The diverter 80 is preferably sized to fit between the conveyors 50 and urge the particulate material outward toward a side exit upward discharge as described below. According to one embodiment the diverter 80 includes a fixed angle of 30°-60°, more preferably 40°-50°, and most preferably approximately 45°. A discharge angle of the diverter 80 to the outlet 30 may depend on the nature of the particulate material.

In a preferred embodiment shown in FIG. 8, the outlet 30 discharges from a side of the pump 10 and includes walls that divert the particulate matter upward relative to the outlet 30, and more specifically upward relative to gravity. In such a way, a seal is created and maintained between the discharge port 160 and the particulate matter through the pump 10. As shown in FIGS. 9 and 10, the discharge port 160 is aligned at an angle relative to horizontal and preferably at an upward or downward angle relative to the horizontal, depending on the nature of the particulate material and/or the application.

According to one preferred embodiment of the invention shown in FIG. 10, the walls of the SEM form a roof 170 positioned above the discharge wherein the roof 170 is provided as a relief 175 at a height sufficient to permit material to flow through the discharge port 160 at its angle of repose. The roof or relief may be sized appropriately based on characteristics of the material and/or the relative angle or position of the discharge port 160.

As described, the side discharge provides numerous benefits over conventional discharge configurations. Such benefits include improved loading; improved start/restart; a gas seal is maintained if pump runs empty; gas seal is insensitive to tile-to-tile variation and interaction; and potentially less consolidation is required to create and maintain the gas seal.

Figure 11:
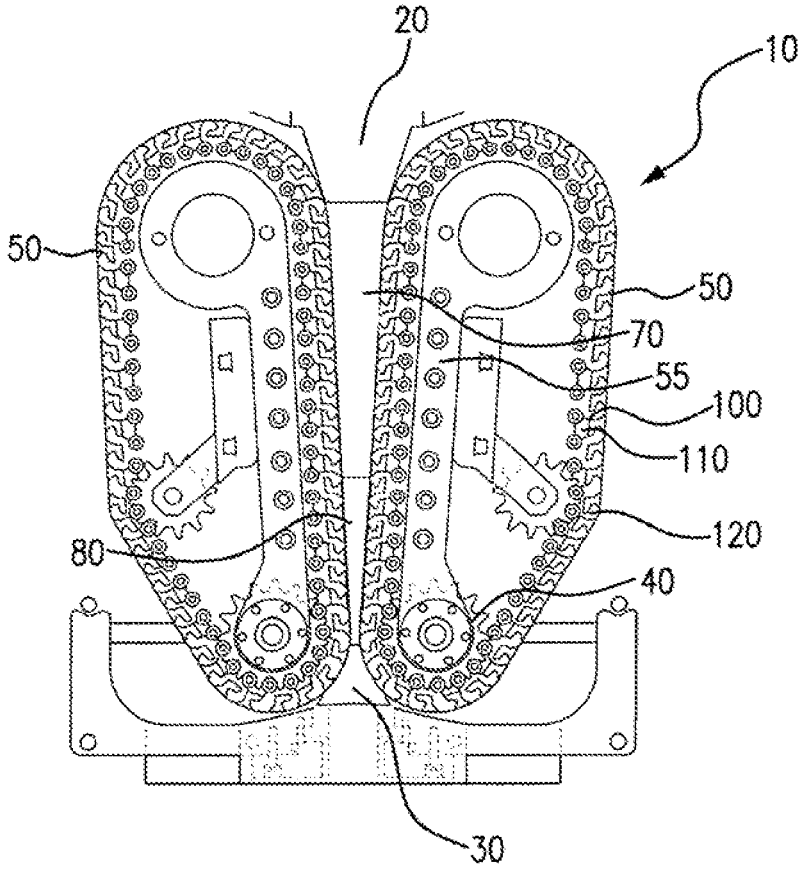
FIG. 11 is a cross-sectional partial front side view of a device according to one preferred embodiment.
Figure 12:
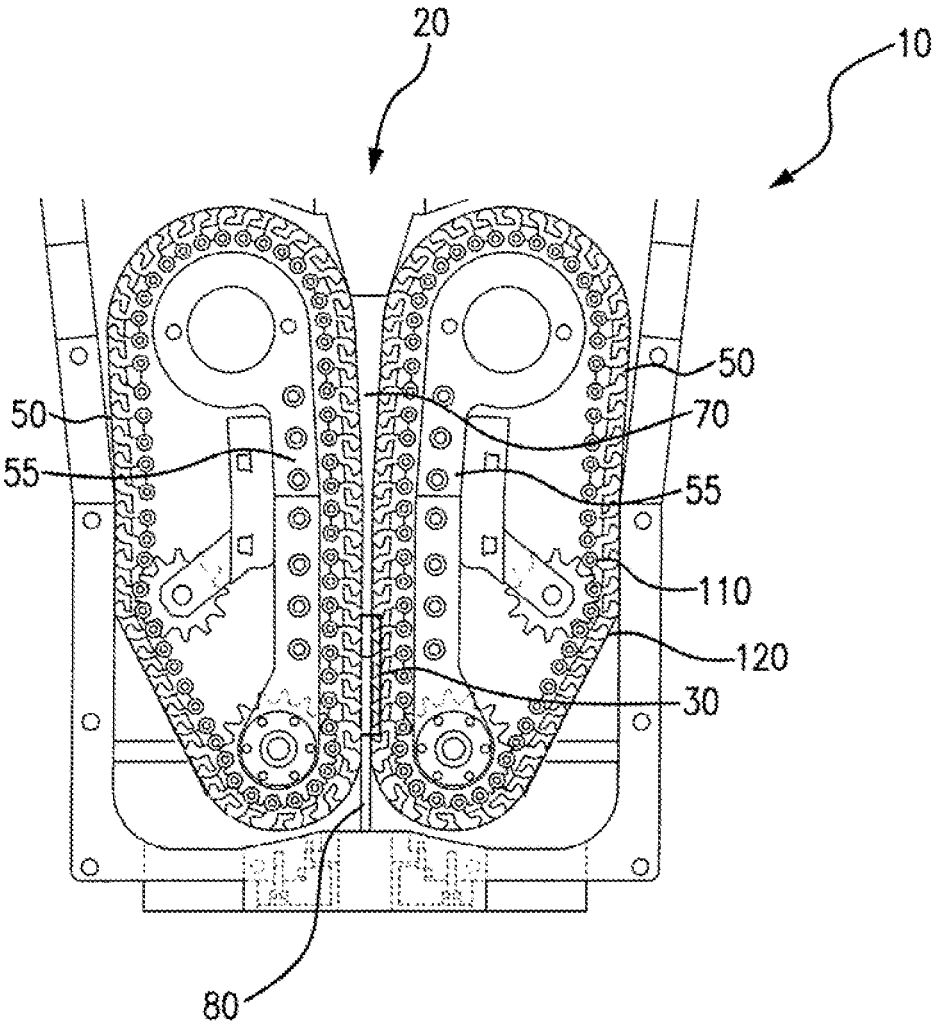
FIG. 12 is a cross-sectional partial front side view of a device according to another preferred embodiment.

As described herein, the working surfaces 125 of the conveyors 50 are preferably canted with respect to each other. Although FIG. 1 shows the conveyors 50 as generally parallel with respect to each other thereby requiring a canted surface perpendicular to a vertical plane, FIGS. 11 and 12 show an additional cant or angle between the two conveyors 50. FIG. 11 shows an arrangement wherein the first load beam 55 and the second load beam 55 taper toward the outlet to create an angle or taper between the conveyors 55. FIG. 12 shows an additional or alternative embodiment wherein the taper between the load beams 55 is nonlinear thereby forming a corresponding tapered relationship between the conveyors 50. Such an arrangement may be particularly adaptable to more compressible particulate materials. In this manner, and as shown, the conveyors may be additionally or alternatively canted relative to a vertical plane or direction of travel.

Figure 13:
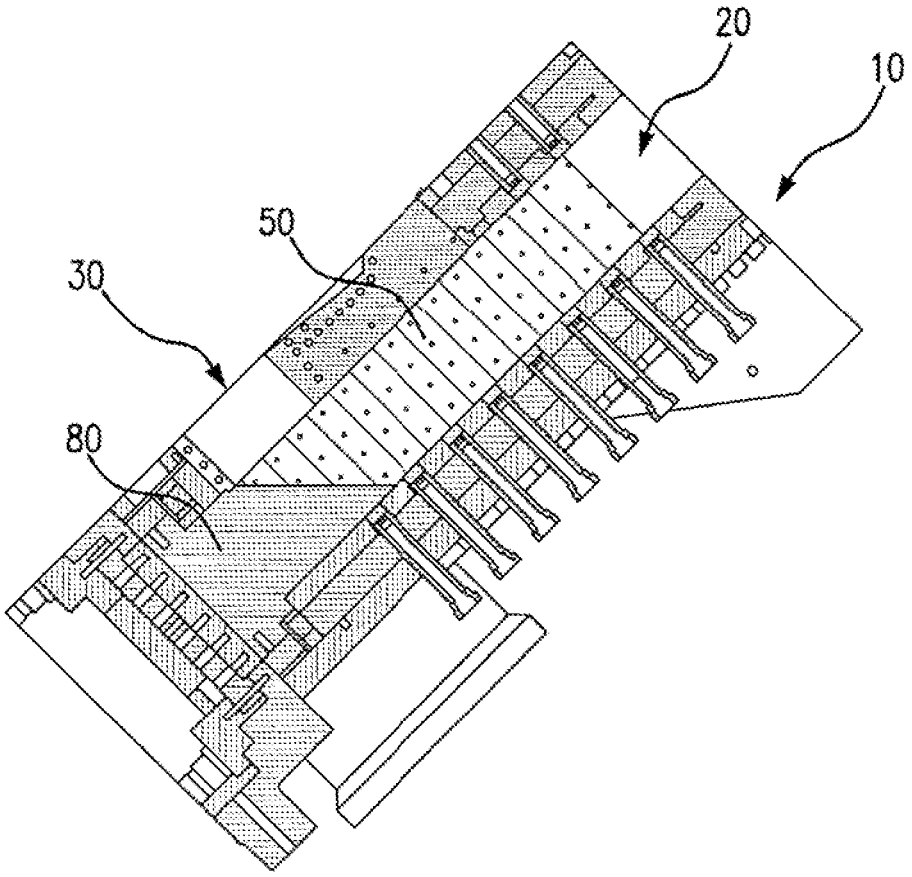
FIG. 13 is a side view of a particulate pump positioned at an angle relative to vertical according to one preferred embodiment.

Further, although as described herein, the particulate pump 10 is shown as oriented in a vertical direction so that the path of travel of the particulate matter is generally parallel to gravity, FIG. 13 shows an alternative embodiment. As shown in FIG. 13, the particulate pump 10 may be angled relative to vertical so as to feed particulate matter into the inlet at an angle relative to vertical and convey the particulate matter at an angle relative to vertical.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

We claim:

1. A pump for transporting particulate material comprising:

a first belt assembly and a second belt assembly together defining a passage, wherein a working surface of each of the first belt assembly and the second belt assembly are canted with respect to each other relative to a plane of conveyance;

an inlet for introducing the particulate material into the passage;

an outlet for expelling the particulate material from the passage, the outlet positioned out of line with the inlet, the first belt assembly and the second belt assembly each having lateral ends at the working surface with a distance between the ends closest to the outlet being greater than a distance between the ends farthest from the outlet such that the wherein working surfaces of the first belt assembly and the second belt assembly are angled toward the outlet.

2. The pump of claim 1 wherein the first belt assembly and the second belt assembly are tapered with respect to each other away from the outlet.

3. The pump of claim 1 further comprising:

a first load beam positioned within an interior section of the first belt assembly;

a second load beam positioned within an interior section of the second belt assembly;

a drive assembly for driving the first belt assembly and the second belt assembly.

4. The pump of claim 3, wherein the first load beam and the second load beam taper toward the outlet.

5. The pump of claim 4, wherein the taper between the first load beam and the second load beam is nonlinear.

6. The pump of claim 1, wherein each of the first belt assembly and the second belt assembly comprises a plurality of segments, each segment having a working surface that is angled with respect to a plane of travel.

7. The pump of claim 1 wherein the outlet comprises a side exit upward discharge that discharges from a side of the pump and includes walls that divert the particulate matter upward relative to the outlet.

8. The pump of claim 7 wherein the walls extend toward a discharge port aligned at an angle relative to horizontal.

9. The pump of claim 8 wherein the walls form a roof positioned above the discharge port wherein the roof includes a relief that terminates at a height sufficient to permit the particulate material to flow at its angle of repose.

10. A particulate transporting pump comprising:

an inlet for introducing particulates;

an outlet for expelling the particulates, the outlet offset relative to the inlet, wherein the outlet comprises a side exit upward discharge that discharges from a side of the pump and includes walls that divert the particulate matter upward relative to the outlet;

a first belt assembly positioned between the inlet and the outlet; and a second belt assembly positioned between the inlet and the outlet, wherein the first belt assembly and the second belt assembly are positioned opposite each other to form a particulate passageway, the passageway narrowed away from the outlet, the outlet adjoining the passageway at a lateral side of the first and second belt assemblies.

11. The pump of claim 10, wherein each of the first belt assembly and the second belt assembly comprises a plurality of segments pivotally connected to each other, and wherein each of the segments include a tile with an angled working face.

12. The pump of claim 10, further comprising a driving mechanism that transports the particulates under mechanical load.

13. The pump of claim 11, wherein the working face of neighboring pairs of the segments overlap.

14. The pump of claim 10 wherein the outlet discharges from a front side of the pump and includes a side exit upward discharge having walls that divert the particulate matter upward relative to gravity and the outlet.

15. The pump of claim 14 wherein the walls extend toward a discharge port aligned at an angle relative to horizontal.

16. The pump of claim 11 wherein each tile includes a groove along a side of the tile to accommodate a seal.

17. A pump for transporting particulate material comprising:

a first belt assembly and a second belt assembly together defining a passage, wherein a working surface of each of the first belt assembly and the second belt assembly are canted with respect to each other;

an inlet for introducing the particulate material into the passage;

an outlet for expelling the particulate material from the passage, the outlet positioned out of line with the inlet, wherein the outlet comprises a side exit upward discharge that discharges from a side of the pump and includes walls that divert the particulate matter upward relative to the outlet, wherein the walls extend toward a discharge port aligned at an angle relative to horizontal and wherein the walls form a roof positioned above the discharge port wherein the roof includes a relief that terminates at a height sufficient to permit the particulate material to flow at its angle of repose, the outlet adjoining the passage at a lateral side of the first and second belt assemblies.

* * * * *